United States Patent [19]

Goncalves

[11] Patent Number: 4,506,810

[45] Date of Patent: Mar. 26, 1985

[54] DOSAGE DISPENSER DEVICE

[75] Inventor: Antonin Goncalves, Groslay, France

[73] Assignee: L'Oreal, Paris, France

[21] Appl. No.: 397,862

[22] Filed: Jul. 13, 1982

[30] Foreign Application Priority Data

Jul. 21, 1981 [FR] France ..... 81 14132
Jun. 29, 1982 [FR] France ..... 82 11422

[51] Int. Cl.[3] ..... B65D 83/00

[52] U.S. Cl. ..... 222/391; 222/543; 74/128

[58] Field of Search ..... 401/179, 180; 604/209, 604/210, 224; 222/153, 391, 392, 543, 179.5, 386, 340; 74/128, 167

[56] References Cited

U.S. PATENT DOCUMENTS

| | | | |
|---|---|---|---|
| 1,370,665 | 3/1921 | Moore . | |
| 2,488,638 | 11/1949 | O'Connor | 401/179 |
| 2,521,882 | 9/1950 | Swift et al. | 222/340 |
| 3,215,320 | 11/1965 | Heisler et al. | 222/391 |
| 3,348,740 | 10/1967 | O'Donnell | 222/153 |
| 3,741,447 | 6/1973 | Miles et al. | 222/543 |
| 4,308,977 | 1/1982 | Sigmund et al. | 222/386 |
| 4,331,267 | 5/1982 | Duncan et al. | 222/153 |

FOREIGN PATENT DOCUMENTS

| | | |
|---|---|---|
| 11822 | 11/1979 | European Pat. Off. . |
| 28727 | 5/1981 | European Pat. Off. . |
| 3007954 | 9/1981 | Fed. Rep. of Germany . |
| 850458 | 9/1939 | France . |
| 1519772 | 2/1968 | France . |
| 1596074 | 7/1970 | France . |

*Primary Examiner*—H. Grant Skaggs
*Attorney, Agent, or Firm*—Cushman, Darby & Cushman

[57] ABSTRACT

A device for dispensing a viscous product comprises a cylindrical barrel having a piston sealingly slidable therewithin under the action of a reciprocating rack actuated by a manually-operable push-button. The piston includes a sealing skirt which is separate from the catch-engagement lips which allow unidirectional entrainment of the piston by the reciprocating rack, and it serves to seal the piston to the rack to prevent wastage of product.

9 Claims, 4 Drawing Figures

DOSAGE DISPENSER DEVICE

DESCRIPTION

The present invention relates to a dosage dispenser device, and in particular to a device capable of dispensing precise doses of high viscosity products, such as pastes, creams, toothpastes or liquid soaps.

There is already known from French Pat. No. 1,596,074 a dosage dispenser device for viscuous products, comprising a substantially rigid barrel containing the products to be dispensed, an outlet opening for the said products, and means which may be actuated manually for dispensing the product, these manually actuatable means consisting of a piston displaceable within the barrel, an actuator rack rod passing through the piston and integral with a push button allowing it to be reciprocably displaced translationally within the barrel, and a catch engagement element carried by the piston imparting thereto the forward movement of the rack but not the return movement, the push button being pushed back into the return direction by a spring applied under the push button.

The piston of the device described in said French Pat. No. 1,596,074 has a central portion composed of radial strips supported on the notches of the rack. These radial strips ensure the seal between the piston and the rack, but since they simultaneously ensure the catch function, it goes without saying that they cannot seal completely, since the paste product contained in the barrel has a tendency to escape through the central portion of the piston on each actuation of the push button, because the strips will then disengage themselves from the rack notches. In these circumstances, when the piston arrives at the end of its travel a certain quantity of the product has not been dispensed. Moreover, the paste product is not really protected from the air and this may adversely affect its proper preservation.

The object of the present invention is to overcome this drawback with a dosage dispenser which is simple, practical, reliable, particularly small and cheap enough to be disposable.

Accordingly, the present invention provides a dispenser for viscous products comprising:- a substantially rigid barrel defining a compartment for containing the product to be dispensed; a discharge passage for dispensing said product outside the barrel; a piston slidable within said barrel in a leakproof manner with frictional resistance towards the discharge passage; a rack extending within the said barrel over practically the whole length thereof and passing through said piston, said rack being capable of displacement between two positions; a manually operable push button at one end of the barrel and integral with the said rack in order to displace the rack between said two positions, said push button being spring biased for return movement; a sealing lip at the centre of the piston bounding a passage for the rack and forming a seal between the rack and the piston, the outer diameter of the rack and the diameter of the inner opening of said sealing lip being such that the rack passes through the piston in a practically leakproof manner, but with low or substantially zero friction; and a catch engagement element integral with the piston and formed by at least one elastic flap sloping towards the rack and having been moulded integrally with the piston and having its end or ends intended to cooperate with the successive notches of the rack constituting a catch-engagement lip which is independent from the sealing lip, whereby said at least one catch engagement flap imparts to the piston the forward movement of the rack but not the return thereof, and repeated depression of the push button is effective for dispensing doses of the product in a repetitive manner through the said discharge passage.

Preferably the piston has a central skirt to receive the rack and the edging of this skirt, on the side of the compartment wherein the product is located, contracts to form the sealing lip.

More preferably there are two engagement lips each formed by the end of one of two elastic flaps whose other ends are integral with the end of a skirt, or parts of a skirt, carried by the piston. Advantageously the catch comprises two diametrically opposite said elastic flaps to impart to the piston a driving-in force applied at its centre which does not tend to unbalance it or to cause it to jam. In this case provision is advantageously made for two diametrically opposite skirt portions for fixing the two elastic flaps which form the catch.

In the known way, the piston comprises on its periphery at least one lip intended to ensure the seal between the said piston and the inner wall of the cylindrical barrel, the piston being capable of sliding with friction within the said barrel. According to a particular embodiment the piston is constituted by a cylindrical wall carrying at its top part two peripheral lips ensuring the seal between the barrel and the piston and at its bottom part two diametrically opposite skirts, each formed by a cylindrical skirt portion situated in the extension of the cylindrical wall, and by a wall sloping towards the rack. The abovementioned two sloping walls are interconnected by a wall which is perpendicular to the piston axis, this wall having a central perforation edged by the skirt carrying the sealing lip.

The rack has at least one plane of symmetry and preferably an axis of symmetry of revolution.

The spring is desirably moulded integrally with the push button and the rack.

In a particularly worthwhile variant of the invention the device may be made as four moulded components of a plastic material, that is to say: a cylindrical barrel having an open end and having towards the other end, and at a certain distance from the latter, an inner wall provided with a passage opening for the rack; an integrally moulded hinged stopper capable of being fixed, preferably by catch engagement, on the open end of the barrel; a push button-rack unit, which is also integrally moulded, having an axial rack whose one end passes through the said opening of the wall and then ends up in a push button which emerges from the barrel and is capable of sliding within the latter, the said push button having integral elastic strips forming the return spring and bearing on the said barrel wall; and a piston as defined above.

The device obturating the barrel end on the opposite side from the push button, is more desirably an attached bottom provided with an end fitting forming the ejection passage, the said ejection passage itself being capable of being obturated by a cap ensuring stable support for the device.

In a worthwhile variant of the invention provision is advantageously made, at the level of the push button and of the barrel, for a peripheral severable strip preferably carried by the push button, this strip normally preventing a movement of the push button in the direction of ejection, that is to say in the forward direction, as long as the push button has not been pressed sufficiently hard to break the strip.

In order that the invention may more readily be understood there will be described below two embodiments shown in the attached drawings by way of purely illustrative and non-restrictive examples. In these drawings.

Figure 2:
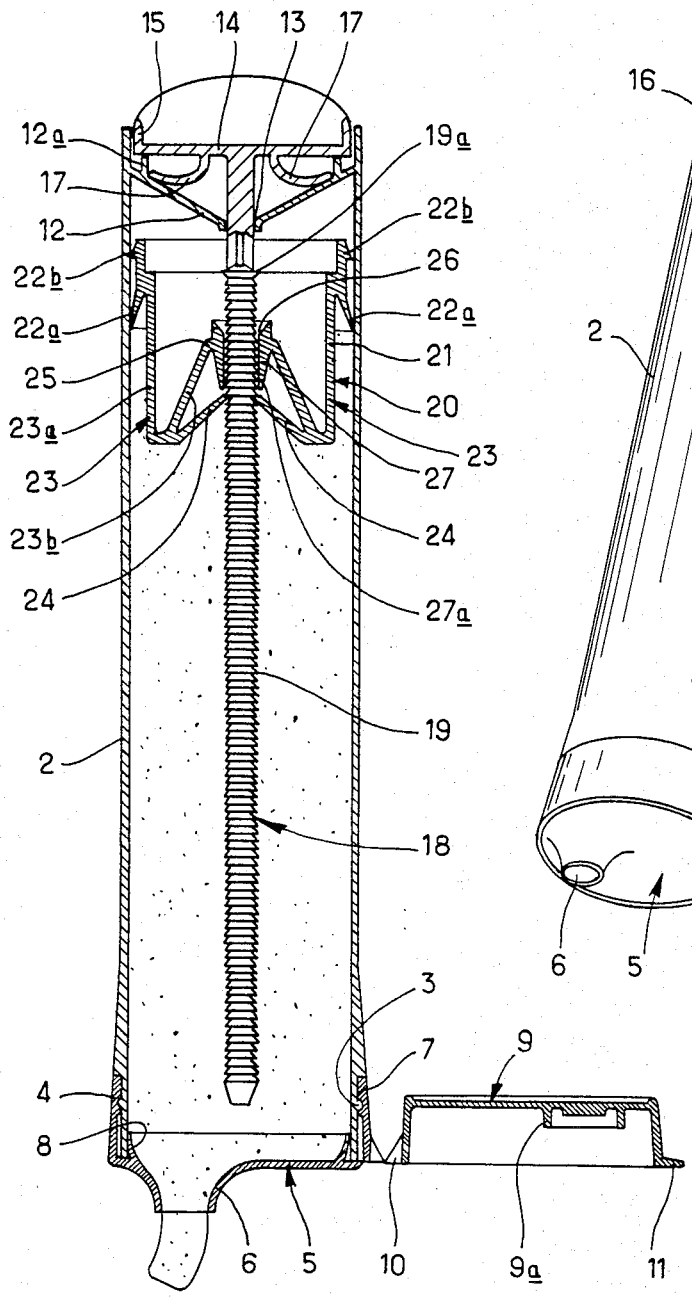
FIG. 2 is an axial cross-section of the toothpaste dispenser of FIG. 1 in its position of use.
Figure 1:
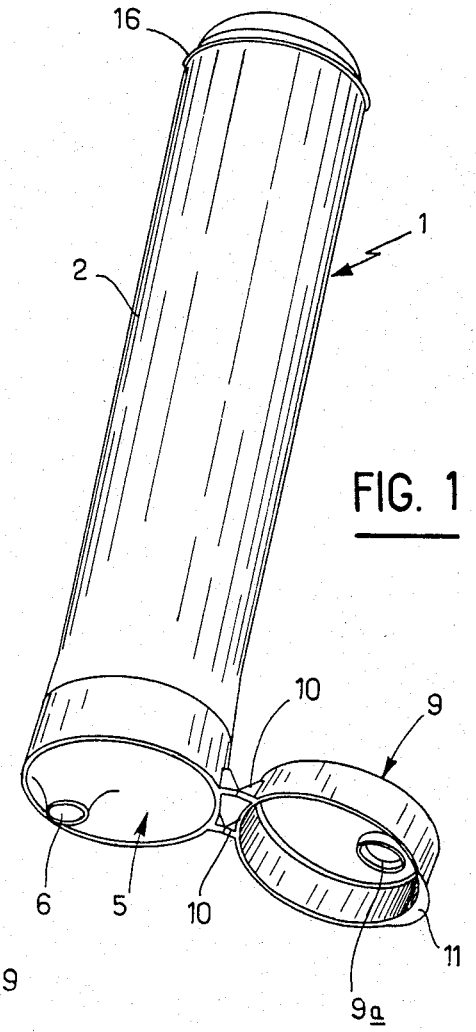
FIG. 1 is a view in perspective of a toothpaste dispenser according to the invention, the obturating cap of the said device being in an open position.

Referring to FIGS. 1 and 2 of the drawings, it will be seen that 1 designates as a whole a toothpaste dose dispensing device made simply of four moulded components and which, therefore, is particularly cheap to manufacture and assemble.

This device comprises a cylindrical barrel 2 having, in a recess of its lower end, a projection 3 which is fitted by catch-engagement in a peripheral groove 4 of an attached bottom 5. Bottom 5 is provided with an eccentrically positioned end fitting 6 forming an ejection opening, there being a peripheral wall 7 carrying the groove 4 and surrounding the end of barrel 2, whilst an inner sealing lip 8 is force-fitted inside the barrel 2. The bottom 5 is connected to a moving cup-shaped cap 9; and this cap is articulated in relation to the bottom 5 by means of a film hinge 10 disposed in a zone which is diametrically opposite to the eccentric end fittings 6. The bottom 5, cap 9 and hinge 10 are integrally moulded. The cap 9 has, preferably on the opposite side from hinge 10, an outer grip projection 11 allowing the user to grip cap 9 easily and to cause it to pivot around hinge 10, thus freeing the ejection opening. Cap 9 carries internally a skirt 9*a* intended to surround the opening 6 in the closed position of the cap.

A frusto-conical inner partition 12 is arranged in the vicinity of the upper end of cylindrical barrel 2; it is arranged as a funnel converging in a direction towards the inside of the cylindrical barrel 2. This partition 12 is provided with a central passage 13 and divides the cylindrical barrel 2 into two compartments, namely a larger compartment comprised between partition 12 and the attached bottom 5, wherein the toothpaste is accommodated, and a smaller compartment which is open towards the top and wherein a push button 14 of plastic material is slidable without friction. Moreover, in the vicinity of the cylindrical wall of the barrel 2, the inner partition 12 has a circular rib 12*a*. The push button 14 is plate shaped and is guided at its circumference 15 by the inner surface of the barrel 2 near the top end of the barrel. Around its circumference the push button has a circular security strip 16 (FIG. 1) which bears on the end of barrel 2 and thus prevents the push button from being pushed inside barrel 2 before a predetermined force has been applied to the push button 14 sufficient to break a strip 16 and to separate it from the rest of the push button.

The side of push button 14 which faces the funnel-shaped partition 12 is kept at a distance from the partition by means of a return spring 17 integrally moulded with the push button 14.

The spring 17 is formed by two diametrically opposite elastic strips which bear on the inner wall 12 and rib 12*a* and which tend to return the push button outwardly of the barrel 2, that is to say upwardly. The elastic strips are attached to the flat wall of push button 14 in its central region.

Push button 14 is extended axially by an actuator rod 18 passing with clearance through the central passage 13 of the inner partition 12. Rod 18 is integral with the flat wall of the push button 14 and is coaxial within the barrel 2 of the dispenser 1, extending as far as the vicinity of the lower end of the cylindrical barrel. It carries a rack 19 having a symmetry of revolution, this rack being formed by an alternation of grooves and flanges. It will be seen that the first tooth 19*a* of the rack has a shape such that it prevents the upward extraction of the rack through the opening 13 of partition 12. Preferably this end tooth 19*a* is bevelled, and the opening of the wall 12 is also bevelled to make it possible during assembly to introduce the rack 18 via the opening of wall 12 by deformation; extraction is on the other hand rendered impossible. Tooth 19*a* thus fixes the top position of the push button 14 urged upwardly under the action of spring 17.

Within the barrel 2 is a piston 20 which is slidable with frictional resistance and is constituted by a cylindrical wall 21 carrying at its top part two external peripheral lips 22*a* and 22*b* intended to seal between the inner wall of the barrel 2 and the exterior of piston 20; at its bottom part the piston has two diametrically opposite skirt portions 23 each carrying a catch 24 which is to be described later.

Each skirt portion 23 is in fact formed by a sector 23*a* of a cylindrical skirt situated in the extension of wall 21 and by a wall 23*b* sloping upwardly and inwardly and having its base joined to that of the cylindrical skirt portion 23*a*. At their top parts, the two walls 23*b* are interconnected by a wall 25 which is perpendicular to the piston axis and has a central perforation 26 edged by a substantially cylindrical skirt 27 which is slightly flared in its top part on the side of wall 12 in order to facilitate the introduction of the rod of the rack. The skirt 27 forms, at its lower part, a frusto-conical circular lip 27*a* sealing between the piston 20 and rack 18.

Catches 24 are formed by elastic strips whose free ends are capable of cooperating with the notches of rack 18 and which are upwardly convergent to define a catch engagement lip which is near the sealing lip 27*a*, but is nevertheless not joined thereto.

To effect the assembly of device 1, the push button-rack unit is first installed, by introducing the rod of the latter via opening 13 in the funnel-shaped partition 12 and by lowering it until tooth 19*a* is positioned behind this opening within the barrel 2. Piston 20 is then introduced, via the free opening of barrel 2, and is pushed down by means of an elongated tool until it occupies the high position near the inner partition 12. Barrel 2 is then filled with toothpaste and the closing components 5, 9 are attached.

When the user wishes to dispense a dose of toothpaste contained in the barrel 2, he pivots the cap 9 around hinge 10 to free the discharge opening of end fitting 6. After having pointed barrel 9 in the required direction he then merely presses the push button 14 against the spring 17 which produces movement of the rack 18 in the direction towards the end fitting 6. This forward movement of the rack 18 causes the catch engagement flaps 24, which engage one of the teeth 19 of rack 18, to be carried along by the rack. The flaps 24 carry the piston 20 along with them to accompany the rack 18 during the whole of its forward movement, producing the dispensing, through the opening of end fitting 6, of a dose of toothpaste corresponding to the distance over which push button 14 and therefore piston 20 have been displaced. When the user relaxes his pressure on the push button 14 the spring 17 returns it to its initial position, carrying with it the rack of rod 18 with which it is integral.

On the other hand, by reason of the friction of its lips *22a, 22b,* the piston 20 remains in place in its new lower position; as a result the rack 18 is displaced relative to the piston 20 through the central opening thereof, this movement being allowed by the flaps 24 which do not impose any resistance to this return movement of the rack 18 and push button 14. As a result, when the rack 18 has returned to its top position, the catch engagement flaps 24 are no longer seated in the same notch of the set of the rack teeth but instead engage a notch which is further from the push button 14. The user then replaces cap 9 in position on the device.

Until the piston 20 arrives in its lowermost end position near the bottom 5, it is possible to dispense practically constant individual doses of paste by successive pressures on push button 14. It will be understood that, thanks to the seal between piston 20 and rack 18 at the level of lip *27a* the paste product contained within the barrel 2 does not tend to escape via the central portion of piston 20 and thus all, or practically all, the quantity of the product contained in barrel 2 has been dispensed by successive doses by the time piston 20 has arrived in its lowermost position. Moreover the paste product remains constantly protected from contact with the air, because of the sealing effect of the piston 20 which achieves excellent preservation of the product.

Figure 3:
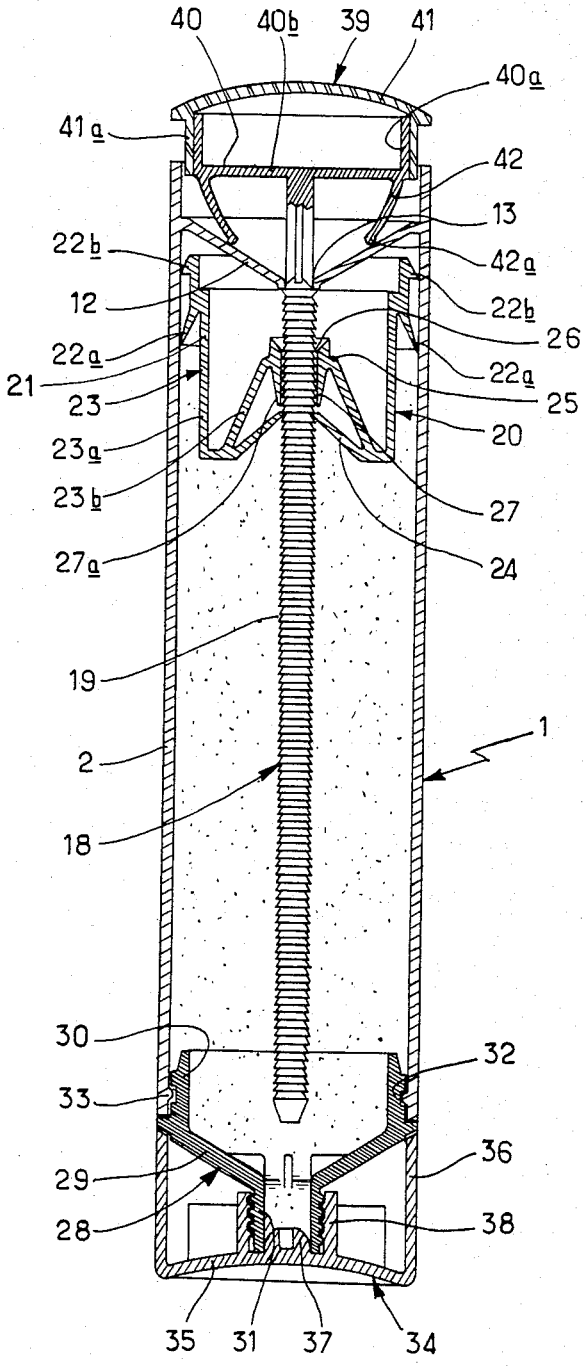
FIG. 3 is an axial cross-sectional view of an alternative embodiment of a device according to the invention, in its rest position, that is to say when not dispensing.
Figure 4:
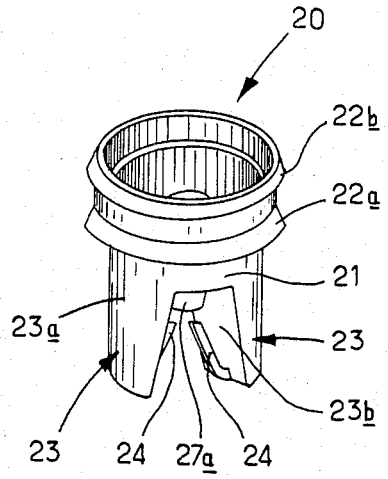
FIG. 4 is a view, in perspective, of the piston equipping the dosage dispenser of FIGS. 1 to 3.

FIG. 3 shows a dispenser device which is similar to that of FIG. 2 but with the difference that the system of obturating barrel 2 at its bottom, and the push button 14, have been obtained in a different manner.

The bottom end of the barrel 2 is closed by a funnel-shaped attached bottom 28. The conical wall 29 of component 28 is extended along its outer edge by a cylindrical wall 30 and has at its centre a threaded hollow end fitting 31 forming the discharge passage for the toothpaste. The cylindrical wall 30 is provided on the outside with an annular groove 32 for catchfitting engagement with a peripheral retaining ring 33 in the inner wall of the barrel 2.

The end fitting 31 may be closed by a cap 34 formed by a base 35 serving as a stand ensuring balanced support for the device 1. The base 35 has three coaxial skirts, namely:

(a) an outer skirt 36 serving as covering and which, for this purpose, becomes an extension of the cylindrical wall of the barrel 2 and on which the user acts in order to screw and unscrew the cap 34;

(b) a short inner skirt 37 intended to seal and which for this purpose penetrates inside the end fitting 31, on tightening; and (c) an intermediate skirt 38 comprising an external thread intended to cooperate with the thread carried by the end fitting 31.

In the embodiment of FIG. 3 the push button 39 is formed by a plate 40 comprising a cylindrical edging wall *40a* and having a bottom face *40b* disposed transversely in the top opening of barrel 2; if required the plate 40 may be surmounted by a detachable cap 41 having an outer skirt *41a* coming to surround the cylindrical wall *40a*. The return spring is formed by elastic strips 42 which are attached to the wall *40b* near its periphery. At the end of each strip 42 is a foldback *42a* facilitating the bearing action on the funnel-shaped partition 12.

It shall be duly understood that the embodiments described above are in no way restrictive and may give rise to any desirable modifications without thereby departing from the scope of the invention as defined by the following claims.

I claim:

1. A dispenser for a viscous product comprising:

(a) a substantially rigid barrel having an open end and having towards the other end an inner wall partition provided with a passage opening, said barrel being a molded component and defining a compartment for containing the product to be dispensed;

(b) means defining a discharge passage for said product and adapted to be mounted on said open end of said barrel;

(c) manually operable push button means at the other end of the barrel and integral with a rack passing through said passage opening, in order to displace said rack between a first and a second position, said rack having teeth;

(d) a molded piston mounted for sliding in a leakproof manner with frictional contact along the said barrel from the inner wall partition to the open end of the barrel, said piston comprising molded integrally with it:

sealing lip means adjacent the center of the piston bordering a rack passage and providing a seal between the rack and the piston, said lip means being provided at the lower part of a skirt connected by walls, which converge toward said other end, to a cylindrical wall of the piston;

catch-engagement means comprising elastic flap means adapted to engage the teeth of the rack, said elastic flap means being convergent toward said other end of said barrel to define a catch engagement lip which is adjacent said sealing lip, said catch-engagement means being effective to impart to the piston the movement of the rack from said first position to said second position, but being flexible so as to move over the rack teeth when said rack moves toward said other end of the barrel, said piston being of a size that said piston is insertable through said open end of said barrel and said rack being insertable through the other end of said barrel and through said passage opening in said piston.

2. A device according to claim 1, wherein the piston has a substantially cylindrical central skirt defining the rack passage, said skirt having an edge which faces said product-receiving compartment of the barrel and converges to form the sealing lip means.

3. A device according to claim 2, wherein said piston includes a cylindrical wall having a surface facing the interior of said barrel, said surface of said piston having first and second peripheral lips for sealing between the barrel and said piston, said piston having at one end thereof a first face and at an opposite end thereof a second face with said first and second peripheral lips being nearer said first face than said second face of said piston, said skirt being nearer to said second face of said piston than said first face.

4. A device according to claim 1, wherein said piston carries mounting skirt means, and wherein there are several said catch-engagement lips, each formed by the first end of a said elastic flap whose second end is integral with said mounting skirt means carried by the piston.

5. A device according to claim 4, wherein said mounting skirt means comprises two mounting skirt portions and wherein there are two diametrically opposite said catch-engagement flaps carried by diametrically opposite said mounting skirt portions.

6. A device according to any one of claims 1, 2, 4 or 5 wherein the piston comprises on its circumference lip means to seal between the said piston and the inner wall of the barrel.

7. A device according to one of claims 1, 2, 4, or 5 wherein spring means are provided, said spring means comprise several elastic strips carried by the push button and being disposed alongside the rack.

8. A device according to one of claims 1, 2, 4, or 5 wherein spring means are provided said barrel including an inner partition adjacent said first end thereof, said spring means bears on said inner partition, and said inner partition is provided with a central passage to receive the rack, and said inner partition is frusto-conical and converges in the direction of said second end of the barrel.

9. A device according to claim 8 wherein said barrel has a cylindrical side wall, and said inner partition has an inner annular rib near said cylindrical wall of said barrel to serve as a stop for said spring means for the rack.

* * * * *